US010297362B2

(12) United States Patent
Koeppendoerfer et al.

(10) Patent No.: US 10,297,362 B2
(45) Date of Patent: May 21, 2019

(54) CABLE WITH ADAPTED STRANDING

(71) Applicants: Erwin Koeppendoerfer, Schwabach (DE); Marta Krzyzak, Allersberg (DE); Guenter Koenig, Schwabach (DE)

(72) Inventors: Erwin Koeppendoerfer, Schwabach (DE); Marta Krzyzak, Allersberg (DE); Guenter Koenig, Schwabach (DE)

(73) Assignee: LEONI KABEL GMBH, Nuremberg (DE)

( * ) Notice: Subject to any disclaimer, the term of this patent is extended or adjusted under 35 U.S.C. 154(b) by 3 days.

(21) Appl. No.: 15/672,957

(22) Filed: Aug. 9, 2017

(65) Prior Publication Data

US 2018/0053582 A1 Feb. 22, 2018

(30) Foreign Application Priority Data

Aug. 16, 2016 (DE) ..... 10 2016 215 252

(51) Int. Cl.

| | |
|---|---|
| ***H01B 5/10*** | (2006.01) |
| ***H01B 7/30*** | (2006.01) |
| *H01B 3/18* | (2006.01) |
| *H01B 9/00* | (2006.01) |
| *H01B 13/02* | (2006.01) |

(52) U.S. Cl.

CPC ..... *H01B 5/104* (2013.01); *H01B 7/30* (2013.01); *H01B 3/18* (2013.01); *H01B 9/006* (2013.01); *H01B 13/02* (2013.01)

(58) Field of Classification Search

CPC . H01B 5/104; H01B 7/30; H01B 3/18; H01B 9/006; H01B 13/02

USPC ..... 174/128.1

See application file for complete search history.

(56) References Cited

U.S. PATENT DOCUMENTS

| | | | | |
|---|---|---|---|---|
| 4,673,775 | A | 6/1987 | Nigol et al. | |
| 5,777,273 | A * | 7/1998 | Woody | H01B 9/003 174/113 R |
| 2015/0318080 | A1 | 11/2015 | Mekala et al. | |

FOREIGN PATENT DOCUMENTS

| | | |
|---|---|---|
| DE | 102008031337 | 4/2010 |
| EP | 362609 A1 | 11/1990 |
| GB | 768828 | 2/1957 |

* cited by examiner

*Primary Examiner* — Tremesha S Willis

(74) *Attorney, Agent, or Firm* — Tarolli, Sundheim, Covell & Tummino LLP

(57) ABSTRACT

The present disclosure relates to a cable. An exemplary embodiment of the cable (2) comprises a plurality of conductors, wherein the conductors form several conductor groups (4, 6*a*-6*d*), in which respectively two or more of the plurality of conductors are stranded with one another. The several conductor groups (4, 6*a*-6*d*) are stranded overall around a common stranding center (1) and the conductors of at least two of the several conductor groups (4, 6*a*-6*d*; 4*a*-4*d*, 6*a*-6*k*) are stranded with one another with a different lay length.

7 Claims, 4 Drawing Sheets

CABLE WITH ADAPTED STRANDING

RELATED APPLICATIONS

The present invention claims priority of DE 10 2016 215 252.1, filed on 16 Apr. 2016, the entirety of which is incorporated herein by reference.

TECHNICAL FIELD

The present disclosure relates to a cable with a plurality of conductors, for example litz wires.

BACKGROUND ART

A single- or multicore combination of cores (single lines) sheathed by insulation materials that is used to transmit energy or information is generally termed a cable. Different plastics are usually used as insulation materials, which enclose the cores used as conductors and insulate them from one another. Electrical conductors mostly consist of copper, less frequently also of aluminium or suitable metal alloys. Viewed three-dimensionally, the cable follows a mostly cylindrical or similar geometry and can in its overall construction also contain further sheath layers of insulating material or metallic foils, or braids for the purpose of electromagnetic shielding or as mechanical protection.

High currents in the order of several amperes and above necessitate a suitably large conductor cross section. In the transmission of alternating signals, such as e.g. alternating current, the current in the conductor cross section is displaced to the conductor surface by internal magnetic fields as the frequency rises. This effect is known as the skin effect. For example, at a frequency of 10 MHz the current density 20 μm below the surface is only the 1/eth part (37%) of the current density on the outermost surface. This means that only a small portion of the overall cross section of the cable carries the main part of the current.

It is known to use cables with litz wires in many electrical engineering fields. A litz wire in electrical engineering is an electrical conductor consisting of thin individual wires. Litz wires are often easy to bend. In electrical cables, copper is often used as a conductor for this. The individual wires of the litz wires (e.g. several hundred individual wires) are mostly enclosed by a common insulating sheath. A conductor formed in this way is normally termed a stranded lead or stranded conductor. If several such lines are combined in a cable, they are often described as cores of the cable.

Compared with solid wire, high-frequency litz wires, the individual conductor surfaces of which are insulated from the other wires of the litz wire, have a higher quality in the high-frequency range. This is based on the enlargement of the cross section effectively involved in the current flow, which cross section is limited in solid wire by the skin effect already cited and also by the so-called proximity effect. The proximity effect is based on the current displacement between two closely adjacent conductors. In normal litz wires, i.e. not high-frequency litz wires with insulated individual wires, the conductors are in contact with one another and the skin effect acts as in solid conductors. In addition, due to the longitudinal propagation of the current and the litz wires turning away underneath, an additional contact resistance is to be found. For this reason normal litz wires tend to be poorer at high frequency (HF) than solid conductors.

To reduce the skin effect and/or the proximity effect, insulation is provided as mentioned between the individual wires in high-frequency litz wires (normally shortened to HF litz wires). Lacquer is often used for the insulation, i.e. the individual wires of a litz wire are insulated from one another by a lacquer coating. This insulation is also provided accordingly if the litz wires carry the same potential. By reducing the skin effect and/or the proximity effect, a larger portion of the overall cross section of the cable participates in transporting the current. However, this approach is elaborate in the manufacture and processing of the cable. In addition, a cable with a complex structure is created.

The requirement exists to provide a simply constructed cable with good properties, such as e.g. good overall efficiency and/or minimum energy consumption and/or minimum self-heating and/or best electromagnetic compatibility.

DISCLOSURE OF THE INVENTION

A cable is provided for this that comprises a plurality of conductors. The conductors of the plurality of conductors form several conductor groups. In the several conductor groups, two or more of the plurality of conductors respectively are stranded with one another. The several conductor groups are stranded overall around a common stranding centre. The conductors of at least two of the several conductor groups are stranded with one another with a different lay length.

The conductors can also be described as electrical conductors. The plurality of conductors can be formed as a plurality of litz wires or as a plurality of solid conductors. For example, the plurality of conductors can comprise several litz wires and/or several solid conductors. Thus a combination of litz wires and solid conductors is also conceivable.

Expressed in another way, so to speak, of the conductors present in the cable, e.g. litz wires and/or solid conductors, conductor groups with two or more conductors respectively, e.g. litz wire groups with two or more litz wires respectively are formed and/or solid conductor groups with two or more solid conductors respectively are formed. The conductors, e.g. litz wires and/or solid conductors, of a conductor group, e.g. litz wire group and/or solid conductor group, are stranded with one another. In at least two conductor groups, e.g. litz wire groups and/or solid conductor groups, the lay length of the stranding differs. The conductor groups, e.g. litz wire groups and/or solid conductor groups, are stranded overall around the common stranding centre.

Stranding (often also termed twisting) is understood as the twisting against one another and the spiral/helical wrapping around one another of fibres or wires. In a twisted line, the individual conductors of an electric circuit change places in relation to one another in their progression. In the stranding of cables, individual wires or wire bundles are twisted against one another. They are wound spirally around a stranding axis/around a stranding centre. The reciprocal influence of electrical conductors is reduced by the stranding/twisting. The stranding/twisting is an effective measure for reducing inductively injected common-mode interference.

In telecommunications, stranding is used to reduce cross coupling. The essential measure in the stranding is the lay length, which is often termed twist rate or twist step. The lay length is the lead of the wire or wire bundle wound spirally around the stranding axis. Due to the stranding, the individual cores are longer than the cable itself. In this case the stranding factor indicates the ratio of the individual core length to the cable length. Relative to the cable described, this means that the stranding factor indicates the ratio of the actual or mechanical length of a conductor group, e.g. litz wire group and/or solid conductor group, to the cable length. The conductors of a conductor group, e.g. the litz wires of a litz wire group and/or the solid conductors of a solid conductor group, usually have the same length. In this case the stranding factor also indicates the ratio of the length of the conductors of a conductor group, e.g. the litz wires of a litz wire group and/or the solid conductors of a solid conductor group, to the cable length.

Due to the different lay length of the two or more conductor groups, e.g. the two or more litz wire groups and/or solid conductor groups, the conductors, e.g. litz wires and/or solid conductors, of the two or more conductor groups differing in lay length, e.g. litz wire groups and/or solid conductor groups, have a different length in terms of their mechanical length. Mechanical length is understood here as the actual length of the corresponding elements in their own longitudinal direction. The mechanical length can therefore be understood as the length of the corresponding elements in an unstranded/unwound state. The electrical resistance of a wire is proportional to its mechanical/actual length. The length of the conductors, e.g. litz wires and/or solid conductors, and of the conductor groups, e.g. litz wire groups and/or solid conductor groups, can be changed and adapted by changing the lay length. The at least two of the several conductor groups, e.g. litz wire groups and/or solid conductor groups, can be formed by using a certain lay length in such a way that they have the same stranding factor, i.e. the same length in relation to the cable length. For example, all of the several conductor groups, e.g. litz wire groups and/or solid conductor groups, can be formed in such a way, for example by selecting suitable lay lengths, that they have the same stranding factor.

If the two or more conductor groups, e.g. litz wire groups and/or solid conductor groups, are formed so that they have the same stranding factor, this has the effect that the currents conducted in their associated conductors, e.g. litz wires and/or solid conductors, reach the end of the cable at least virtually simultaneously with one another. This means that currents conducted in the corresponding conductors, e.g. litz wires and/or solid conductors, can reach the end of the cable following a running time of equal length. Potential differences between the elements of the conductor are minimised, ideally even eliminated, by this. The occurrence of short circuits, which lead to a higher energy consumption or to increased self-heating, is at least reduced or ideally prevented by this. Such short circuits are short current pulses, for example, with high harmonics in some cases. By reducing or avoiding the short circuits, the electromagnetic compatibility (EMC) of the cable is thus increased, i.e. the EMC radiation is minimised or avoided.

The at least two of the several conductor groups, e.g. litz wire groups and/or solid conductor groups, can be arranged in a radial direction of the cable at different positions in the cable. Due to the several conductor groups, e.g. litz wire groups and/or solid conductor groups, having an overall stranding around the common stranding centre, the conductor groups, e.g. litz wire groups and/or solid conductor groups, that are arranged further out in a radial direction of the cable have a greater length than conductor groups, e.g. litz wire groups and/or solid conductor groups, that are arranged further inwards in a radial direction of the cable. The different mechanical length of the conductor groups, e.g. litz wire groups and/or solid conductor groups, and consequently (in the case of the same material) the different electrical resistance of the conductor groups, e.g. litz wire groups and/or solid conductor groups, lead at the same propagation velocity of the signals, for example currents, carried in the conductor groups, e.g. litz wire groups and/or solid conductor groups, to different running times and thus to a time-delayed reception at the end of the line. As described, this can result in short circuits and thus increased energy consumption, increased heating and/or increased EMC radiation. If the at least two of the several conductor groups, e.g. litz wire groups and/or solid conductor groups, which are arranged at a different position in the cable in a radial direction of the cable, are formed so that they have a different lay length, the length difference occurring due to the overall stranding and thus (in the case of the same material) the different electrical resistance can be compensated by the different lay length used in the corresponding conductor groups, e.g. litz wire groups and/or solid conductor groups.

The lay length of the at least two of the several conductor groups, e.g. litz wire groups and/or solid conductor groups, can accordingly be adapted corresponding to their position in the cable in a radial direction. For example, the lay length of all of the several conductor groups, e.g. litz wire groups and/or solid conductor groups, can be adapted corresponding to their position in the cable in a radial direction. It is conceivable, for example, that a first of the several conductor groups, e.g. litz wire groups and/or solid conductor groups, is arranged further out in the radial direction of the cable than a second of the several conductor groups, e.g. litz wire groups and/or solid conductor groups. The conductor group, e.g. litz wire group and/or solid conductor group, lying further out in the radial direction of the cable (the first conductor group) has a greater length on account of the overall stranding than the conductor group, e.g. litz wire group and/or solid conductor group (the second conductor group), lying further inwards in the radial direction of the cable. The lay length of the first of the several conductor groups, e.g. litz wire groups and/or solid conductor groups, can accordingly be chosen to be greater than the lay length of the second of the several conductor groups, e.g. litz wire groups and/or solid conductor groups. Due to the greater lay length of the first conductor group, e.g. litz wire group and/or solid conductor group, than that of the second conductor group, e.g. litz wire group and/or solid conductor group, the greater length of the first conductor group, e.g. litz wire group and/or solid conductor group, occurring on account of the overall stranding can be compensated. For example, the lay lengths of the first and second of the several conductor groups, e.g. litz wire groups and/or solid conductor groups, can be chosen so that the conductor groups, e.g. litz wire groups and/or solid conductor groups, have at least virtually the same length in the cable. Both conductor groups, e.g. litz wire groups and/or solid conductor groups, then achieve at least virtually the same stranding factor. In one example the lay lengths of all conductor groups, e.g. litz wire groups and/or solid conductor groups, can be chosen so that the conductor groups, e.g. litz wire groups and/or solid conductor groups, have at least virtually the same length in the cable. All conductor groups, e.g. litz wire groups and/or solid conductor groups, then achieve at least virtually the same stranding factor.

One or more of the conductor groups, e.g. litz wire groups and/or solid conductor groups, are formed for example as conductor pairs, e.g. litz wire pairs and/or solid conductor pairs. In the conductor pairs, e.g. litz wire pairs and/or solid conductor pairs, two of the plurality of conductors respectively, e.g. two of the plurality of litz wires and/or two of the plurality of solid conductors, are stranded with one another. One or more of the conductor groups, e.g. litz wire groups and/or solid conductor groups, can alternatively be three- or four-strandings, in which three or four of the plurality of conductors respectively, e.g. of the plurality of litz wires and/or of the plurality of solid conductors, are stranded with one another. Conductor pairs (e.g. litz wire pairs and/or solid conductor pairs), three- and four-strandings can be combined with one another in the cable.

The at least two of the several conductor groups, e.g. litz wire groups and/or solid conductor groups, can comprise respectively one conductor, e.g. respectively one litz wire and/or respectively one solid conductor, as a forward conductor and one conductor, e.g. one litz wire and/or one solid conductor, as a return conductor. For example, all of the several conductor groups, e.g. litz wire groups and/or solid conductor groups, can respectively comprise one conductor, e.g. respectively one litz wire and/or respectively one solid conductor, as a forward conductor and one conductor, e.g. one litz wire and/or solid conductor, as a return conductor.

It is conceivable, in addition to the lay length, to adapt the twist of the stranding also of the at least two conductor groups, e.g. litz wire groups and/or solid conductor groups. The lead or pitch of the helix that generally results when the conductors, e.g. the litz wires or wires or solid conductors, are stranded is usually termed twist. The twist is also described as the lay angle. The lay angle $\alpha$ is the angle, so to speak, at which the wire axis intersects the conductor axis, e.g. the litz wire axis or solid conductor axis, in the elevation. A larger/smaller lay angle does not necessarily lead to a larger/smaller lay length. For example, the lay length remains unchanged if the thickness of the cable is increased, in spite of a greater lay angle.

The cable can be formed as a power cable. For example, the cable can be formed to conduct currents of at least 10 A, for example between 40 A and 100 A, e.g. 70 A, at an alternating current frequency between 8 kHz and 200 kHz, for example 85 kHz.

Additional features of the invention will become apparent and a fuller understanding obtained by reading the following detailed description made in connection with the accompanying drawings.

BRIEF DESCRIPTION OF THE DRAWINGS

The present disclosure is to be explained further below with reference to figures. These figures show schematically.

DETAILED DESCRIPTION

Figure 2:
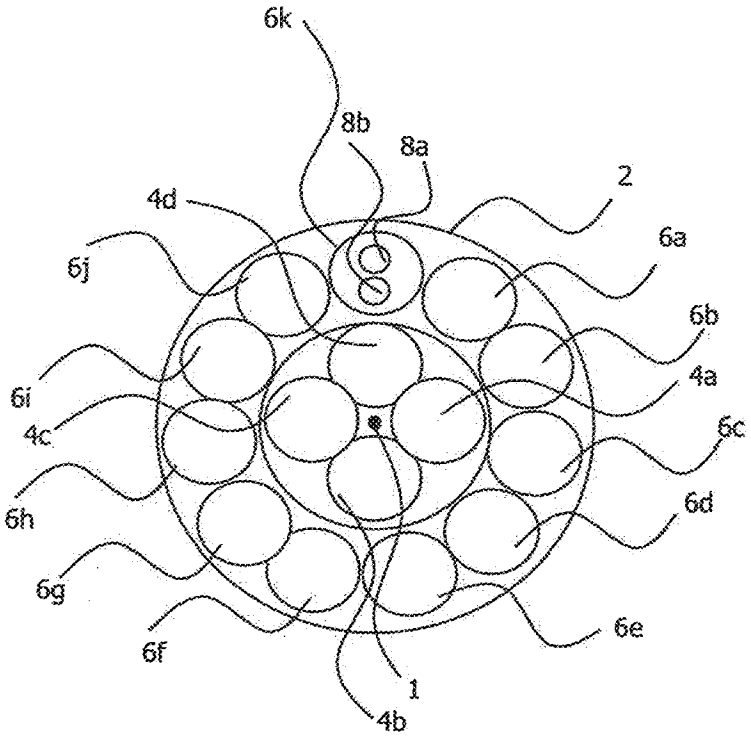
FIG. 2 a cross-sectional view of a possible configuration of a cable according to a second exemplary embodiment.
Figure 3A:
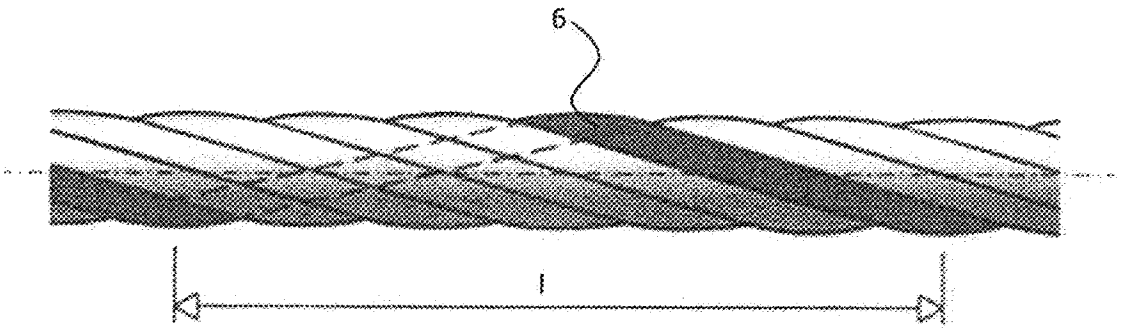
FIG. 3*a* a side view of a cable to explain the lay length.
Figure 3B:
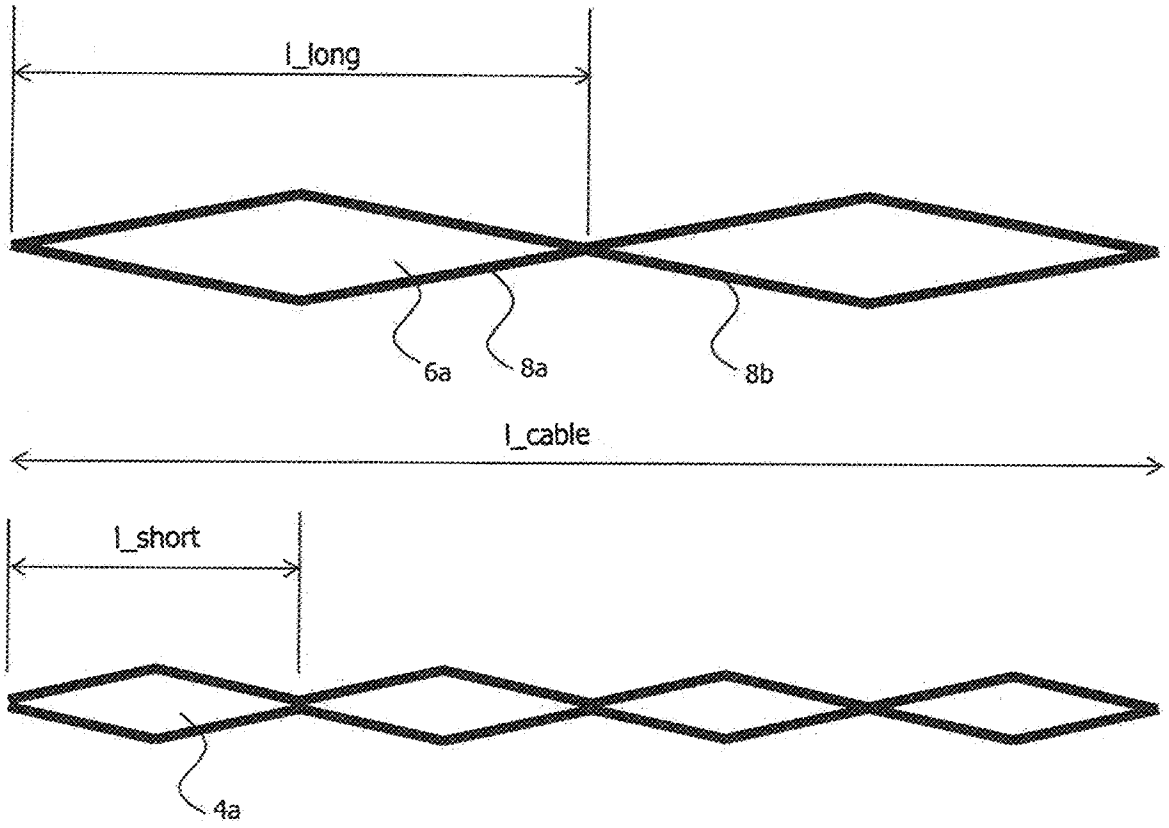
FIG. 3*b* a side view of details of the cable according to the second exemplary embodiment from FIG. 2.

In the following, without being restricted hereto, specific details are presented to supply a complete understanding of the present disclosure. However, it is clear to a person skilled in the art that the present disclosure can be used in other exemplary embodiments, which may deviate from the details set out below. For example, specific configurations and arrangements of a cable are described below that should not be regarded as restrictive. For example, the arrangement according to FIGS. 2 and 3*b* is described in relation to a plurality of litz wires as an example of a plurality of conductors. The arrangement from FIGS. 2 and 3*b* is not limited to this specific arrangement, however, but rather solid conductors or other conductors can also be used as conductors instead of or in addition to litz wires.

The cable described below can be formed as a power cable. For example, the cable can be formed to conduct currents of over 10 A, for example between 40 A and 100 A, e.g. 70 A, at an alternating current frequency between 8 kHz and 200 kHz, for example 85 kHz.

The cable can be used for various applications. This means that various application areas of the cable are conceivable. These application areas can be all application ranges in which high currents and/or great frequencies (e.g. high-frequency range) are used. It is conceivable, without being restricted hereto, for the cable to be used in connection with a device for the inductive charging of vehicles, e.g. pure electric vehicles. One possibility for the inductive charging of vehicles provides that the charging station, e.g. a wall charging station, is connected to a charging arrangement, such as e.g. a charging plate, via a cable/charging cable. The charging arrangement, e.g. the charging plate, can be arranged on the ground and comprise one or more coils. The wall charging station is thus not connected directly to the vehicle for the charging process, but to the charging arrangement. The vehicle can then be charged inductively in a known manner by placing/moving it onto the charging arrangement.

The cable described here can be, without being restricted hereto, said cable/charging cable for connection of a wall charging station to the charging arrangement, for example. The charging cable can have a length of 1 m or more, e.g. of several meters.

Another application area of the cable that can be cited purely as an example is that the cable can be a cable for supplying a sputtering unit with alternating current at high frequencies.

Figure 1:
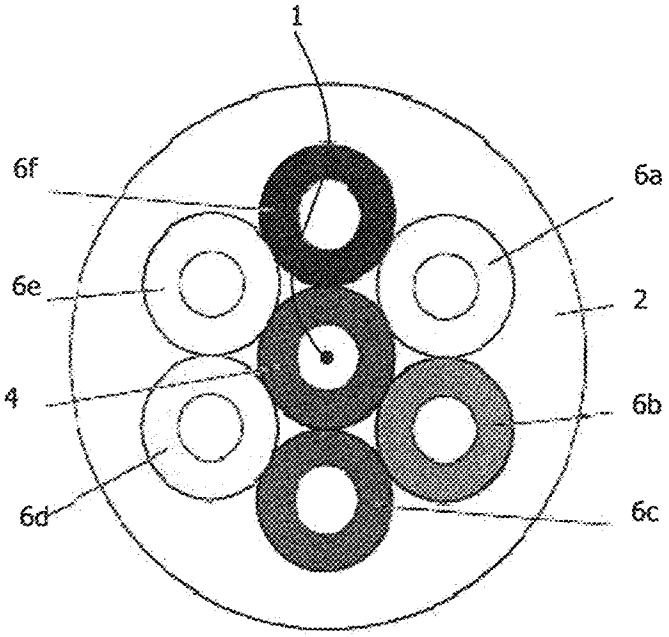
FIG. 1 a cross-sectional view of a possible configuration of a cable according to a first exemplary embodiment.

FIG. 1 shows a cross-sectional view of a cable 2 with seven segments 4, 6*a* to 6*f*, which are insulated from one another and described generally as elements below. The seven elements 4, 6*a* to 6*f* insulated from one another are stranded overall around a common stranding centre 1. This stranding centre 1 is the central axis/longitudinal axis of the cable 2, as shown by way of example in FIG. 1. The inner element 4 (inner in the sense of the position in a radial direction of the cable 2) lies symmetrically around the longitudinal axis of the cable 2 and thus around the stranding centre 1. Furthermore, the outer elements 6*a* to 6*f* (outside in the sense of the position in a radial direction of the cable 2) are stranded around the stranding centre 1 and thus around inner element 4. Since the outer elements 6*a* to 6*f* (outer-lying elements 6*a* to 6*f*) describe a helix/spiral shape, they cover a greater path in the longitudinal direction of the cable 2, i.e. their mechanical length is greater than that of the inner element 4 (element 4 lying inside). An alternating signal, such as e.g. an alternating current/alternating current signal, therefore reaches the end of the cable 2 faster via the inner element 4 than via the outer elements 6*a* to 6*f*. This results in a part of the cable 2, namely the inner element 4, having a different potential for a period of time than other parts of the cable 2, namely the outer-lying elements 6*a* to 6*f*. In this period of time a short circuit can occur inside the cable 2, which short circuit consumes energy on the one hand and on the other leads to increased self-heating of the cable 2. Furthermore, the short current pulse of the short circuit can have high harmonics on account of the high frequency. This can increase the EMC radiation.

Let it be assumed purely by way of example that the propagation velocity of an alternating signal amounts to 60% of the speed of light, for example. Over a 10 m path length the signal thus arrives at the end of the inner element 4 after 55.55 nsec. With a stranding input of 2% assumed, however, the signal at the end of an outer-lying element 6*a* to 6*f* from FIG. 1 is available only after 56.7 nsec. A potential difference, which converts energy in the cable, thus exists between elements of the same cable 2 in the 1.2 nsec.

A reduction in this effect, if not even an avoidance of it, is achieved in that the mechanical length of the outer-lying elements 6*a* to 6*f* is artificially shortened and/or that the mechanical length of the inner-lying element 4 is artificially lengthened. Here the actual length of the corresponding elements in their own longitudinal direction is understood as the mechanical length. The length of the corresponding elements in an unstranded/unwound state can therefore be understood by mechanical length. The mechanical length of the inner-lying element 4 should correspond due to the artificial adaptation at least virtually, ideally exactly, to the mechanical length of the outer-lying elements 6*a* to 6*f*. On account of the at least virtually identical mechanical length, an alternating signal reaches the end of the cable at the same time. Differences in running time are compensated/prevented. Short circuits are therefore reduced or avoided altogether. The elements named in relation to FIG. 1 can be litz wires/litz wire conductors and/or solid conductors as conductors.

An option for artificial adaptation, e.g. artificial lengthening and/or artificial shortening, is now explained in relation to the FIGS. 2 to 3*b*.

FIG. 2 also shows a cross-sectional view of a cable 2 according to an exemplary embodiment. The principles and details explained in relation to FIG. 1 apply correspondingly to the exemplary embodiment from FIG. 2 also. In the example in FIG. 2, the inner-lying element 4 comprises inner cores 4*a* to 4*d*. The outer-lying elements are formed as an example by eleven outer-lying cores 6*a* to 6*k*. In addition, purely by way of example, each inner-lying core 4*a* to 4*d* is formed as a litz wire pair (as an example of a conductor pair) and is accordingly designated below as inner litz wire pair 4*a* to 4*d*. As an alternative example, each inner-lying core 4*a* to 4*d* can be formed as a solid conductor pair. Likewise, each outer-lying core 6*a* to 6*k* is formed by way of example as a litz wire pair (as an example of a conductor to pair) and is accordingly designated below as outer litz wire pair 6*a* to 6*k*. As an alternative example, each outer-lying core 6*a* to 6*k* can be formed as a solid conductor pair. Each litz wire pair 4*a* to 4*d* and 6*a* to 6*k* shown in FIG. 2 comprises, for example, two litz wires 8*a*, 8*b*, as illustrated with reference to the litz wire pair 6*k* in FIG. 2. The litz wires 8*a*, 8*b* can be a forward conductor and a return conductor, for example.

As explained in relation to FIG. 1, due to the overall stranding around the central axis/longitudinal axis of the cable 2 as common stranding centre 1, each outer litz wire pair 6*a* to 6*k* (and thus each outer litz wire) covers a longer path distance than each of the inner litz wire pairs 4*a* to 4*d* (and thus each inner litz wire). Expressed another way, the mechanical length of each litz wire pair 6*a* to 6*k* is greater than the mechanical length of each inner litz wire pair 4*a* to 4*d*. In the exemplary embodiment from FIG. 2 the inner litz wire pairs 4*a* to 4*d* lie at the same level in a radial direction of the cable 2. The mechanical length of each inner litz wire pair 4*a* to 4*d* (and thus of each inner litz wire) and consequently (in the case of the same material) their electrical resistance are identical. The same applies to the outer litz wire pairs 6*a* to 6*k*. This means that in the exemplary embodiment from FIG. 2, the outer litz wire pairs 6*a* to 6*k* lie at the same level in a radial direction of the cable 2. The mechanical length of each outer litz wire pair 6*a* to 6*k* (and thus of each outer litz wire) and consequently (in the case of the same material) their electrical resistance are identical.

This means that the mechanical length of each litz wire pair 4*a* to 4*d*, 6*a* to 6*k* is a function of its position in a radial direction of the cable 2. The mechanical length of the inner litz wire pairs 4*a* to 4*d* and thus of the inner litz wires is shorter than the mechanical length of the outer litz wire pairs 6*a* to 6*k* and thus of the outer litz wires. Alternating signals accordingly reach the end of the cable 2 faster via the inner litz wire pairs 4*a* to 4*d* than via the outer litz wire pairs 6*a* to 6*k*. As explained, short circuits and thus increased energy consumption, increased self-heating and/or increased EMC radiation can be caused by this.

To remedy this problem, the litz wires for forming the outer litz wire pairs 6*a* to 6*k* are stranded with a different lay length than the litz wires for forming the inner litz wire pairs 4*a* to 4*d*. For further explanation reference is made first to FIG. 3*a*, which illustrates the lay length l of a cable in general. As shown in FIG. 3*a*, the lay length l is the lead of the wires laid spirally around the stranding axis. This means that the lay length l of a conductor, e.g. a litz wire or a solid conductor, is the lead measured parallel to the conductor longitudinal axis, e.g. litz wire longitudinal axis and/or solid conductor longitudinal axis, of an outer wire in a complete winding around the axis of the conductor, e.g. of the litz wire or of the solid conductor. The term lay length thus describes the length of the path required by a single wire in the conductor, e.g. in the litz wire or the solid conductor, for a 360° revolution. As explained, in the stranding of (symmetrical) cables, individual wires or wire pairs are twisted/stranded against one another. They are wound spirally, so to speak, around the stranding axis/the stranding centre. Thus a lay length of 70, for example, signifies that the wires have made a spiral stranding of 360 degrees around the stranding axis after 70 cm.

FIG. 3*b* now shows very schematically one of the outer litz wire pairs 6*a* to 6*k*, which is described as the first litz wire pair 6*a* below, and one of the inner litz wire pairs 4*a* to 4*d*, which is described below as the second litz wire pair 4*a*.

As can be recognised in FIG. 3*b*, the litz wires for forming the first (outer) litz wire pair 6*a* are stranded with a lay length l_long, which is greater than the lay length l_short of the stranding of the litz wires for forming the second (inner) litz wire pair 4*a*. This applies likewise to all outer litz wire pairs 6*a* to 6*k* and inner litz wire pairs 4*a* to 4*d*. The mechanical length of the inner litz wire pairs 4*a* to 4*d* and thus of the inner litz wires is lengthened compared with the mechanical length of the outer litz wire pairs 6*a* to 6*k* and thus of the outer litz wires. The lay lengths l_long, l_short can be chosen in this case in particular so that the mechanical length of the inner litz wire pairs 4*a* to 4*d* corresponds at least virtually to the mechanical length of the outer litz wire pairs 6*a* to 6*k*. Expressed another way, the lay lengths can be selected so that the actual lengths of the litz wires of the cable 2 and thus their stranding factors at least virtually correspond to one another in spite of overall stranding around the stranding centre 1 and a different position in a radial direction of the cable 2.

Due to the adaptation described of the stranding or bundling, an approximation of the actual lengths of the conductors, e.g. litz wires or solid conductors, of the cable 2 is achieved. This leads to a marked reduction in the running time difference of alternating signals described above, if not even to complete avoidance. Inner layers of a cable 2 are formed e.g. by a pair-stranded layer, the stranding factor of which is of the same magnitude as the stranding factor of the outer layer. Differences in the running time are avoided by this. The same applies also to divided forward and return conductors as outlined in relation to FIG. 3*b*, which were stranded into a litz wire pair, a core or a cable. Here, too, compensation of the running time differences can be achieved.

Although the invention has been described with a certain degree of particularity, those skilled in the art can make various changes to it without departing from the spirit or scope of the invention as hereinafter claimed.

The invention claimed is:

1. Cable including at least a first group of conductors and a second group of conductors, each group of conductors including a plurality of litz wires, wherein the litz wires form several litz wire pairs in which, respectively, two of the plurality of litz wires are stranded with one another and said litz wire pairs are stranded overall around a common stranding center, and said litz wires of said first group and said litz wires of said second group have the same mechanical length; said litz wire pairs of said first group located at a first radial distance with respect to said common stranding center and said litz wire pairs of said second group located at a second radial position with respect to said common stranding center, said second radial distance being greater than said first radial distance; said litz wire pairs of said first conductor group being stranded with one another at a first lay length and said second group of litz wire pairs being stranded at a different lay length, whereby currents conducted in the first group of conductors and currents conducted in said second group of conductors reach the end of the cable substantially simultaneously.

2. Cable according to claim 1 wherein said lay length of said first group of conductors is shorter than the lay length of the second group of conductors.

3. Cable according to claim 1, wherein the at least two of the several litz wire pairs are formed so that they have a same stranding factor.

4. Cable according to claim 1, wherein all of the several litz wire pairs are formed so that they have a same stranding factor.

5. Cable according to claim 1, wherein the at least two of the several litz wire pairs respectively include one litz wire as a forward conductor and one litz wire as a return conductor.

6. Cable according to claim 1, wherein the cable is formed as a power cable.

7. Cable according to claim 1, wherein the cable is formed for conducting currents of at least 10A at an alternating current frequency between 8kHz and 200kHz.

* * * * *